US005224653A

United States Patent [19]

Nelson et al.

[11] Patent Number: 5,224,653

[45] Date of Patent: Jul. 6, 1993

[54] MODULAR SPRINKLER ASSEMBLY

[75] Inventors: Craig B. Nelson; Paul D. Davisson, both of Walla Walla, Wash.

[73] Assignee: Nelson Irrigation Corporation, Walla Walla, Wash.

[21] Appl. No.: 828,448

[22] Filed: Jan. 31, 1992

[51] Int. Cl.[5] ..... B05B 1/26; B05B 3/02

[52] U.S. Cl. ..... 239/222.17; 239/222.11

[58] Field of Search ..... 239/222.11, 222.17; 215/214, 216, 217, 222

[56] References Cited

U.S. PATENT DOCUMENTS

| | | | |
|---|---|---|---|
| Re. 33,823 | 2/1992 | Nelson et al. | 239/222.17 |
| D. 312,865 | 12/1990 | Davisson | D23/214 |
| 3,613,929 | 11/1971 | Treanor | 215/214 |
| 3,659,735 | 5/1972 | Landen | 215/222 |
| 3,929,287 | 12/1975 | Givler et al. | 239/391 |
| 4,103,797 | 8/1978 | Morris | 215/214 |
| 4,185,781 | 1/1980 | O'Brien | 239/600 |
| 4,399,921 | 8/1983 | Kusz | 215/214 |
| 4,405,085 | 9/1983 | Meyer | 239/726 |
| 4,410,097 | 10/1983 | Kusz | 215/214 |
| 4,434,937 | 3/1984 | Pitchford | 239/230 |
| 4,438,884 | 3/1984 | O'Brien et al. | 239/600 |
| 4,562,964 | 1/1986 | Diamond | 239/600 |
| 4,676,438 | 6/1987 | Sesser | 239/722 |
| 4,747,540 | 5/1988 | Meyer | 239/76 |
| 4,787,558 | 11/1988 | Sexton et al. | 239/205 |
| 4,796,811 | 1/1989 | Davisson | 239/222.17 |
| 4,819,875 | 4/1989 | Beal | 239/97 |

FOREIGN PATENT DOCUMENTS

| | | | |
|---|---|---|---|
| 208390 | 1/1987 | European Pat. Off. | 239/600 |

OTHER PUBLICATIONS

Samples of two prior sprinkler assemblies manufactured by the assignee.

Samples of two prior sprinkler assemblies manufactured by Senniger.

*Primary Examiner*—Andres Kashnikow

*Assistant Examiner*—Lesley D. Morris

*Attorney, Agent, or Firm*—Nixon & Vanderhye

[57] ABSTRACT

A modular sprinkler or sprayhead assembly includes a sprinkler body including an inlet portion adapted for connection to a feed conduit, and an outlet portion for emitting water to atmosphere. A cap is removably attached to the sprinkler body, the cap mounting a distributor assembly (fixed or rotatable) adapted to receive and distribute water emitted from the outlet portion. The cap has a flexible and radially extending latching element releasably engaged within a detent provided on the sprinkler body for releasably holding the cap on the sprinkler body. The distributor assembly may include a brake housing provided with an annular groove, and the cap may then be provided with a hinged projection for releasable engagement with the annular groove. By this construction, the cap and associated distributor comprise a separable unit which is easily assembled and disassembled from the sprinkler body. In turn, the distributor/brake unit is easily assembled and disassembled from the cap.

25 Claims, 3 Drawing Sheets

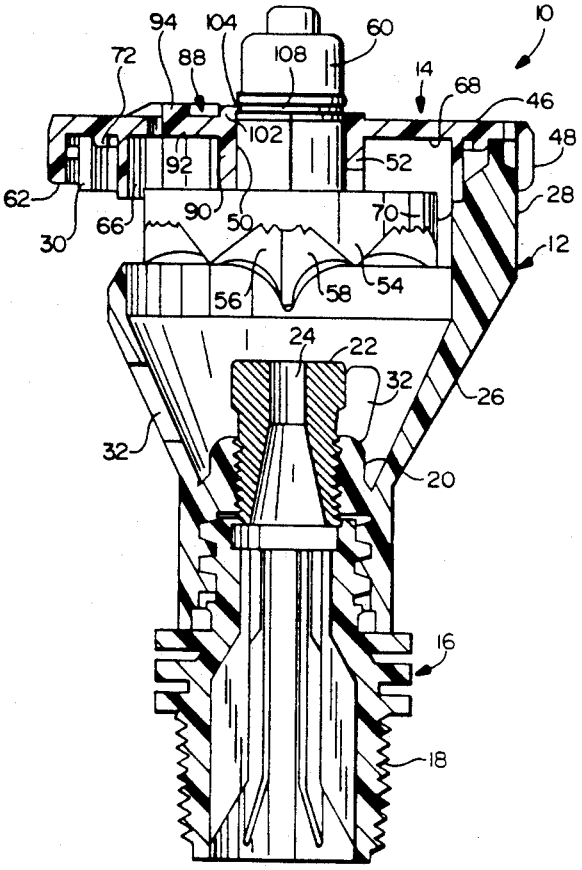
Fig. 1
Fig. 2
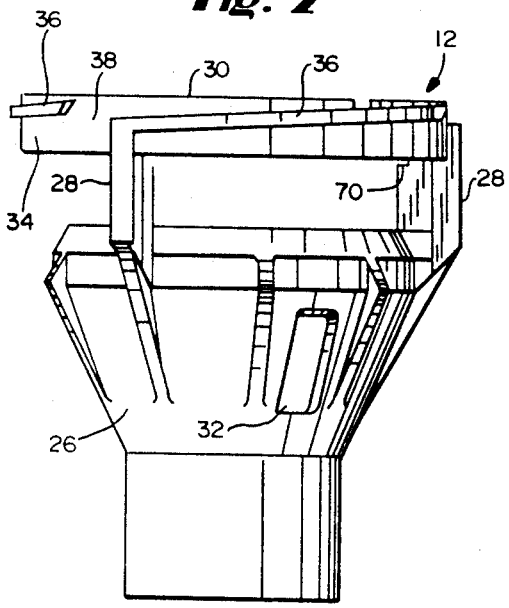
Fig. 3
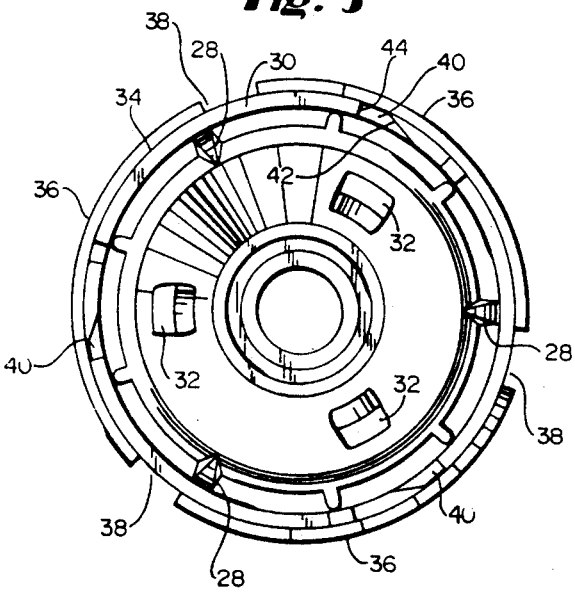

Fig. 4
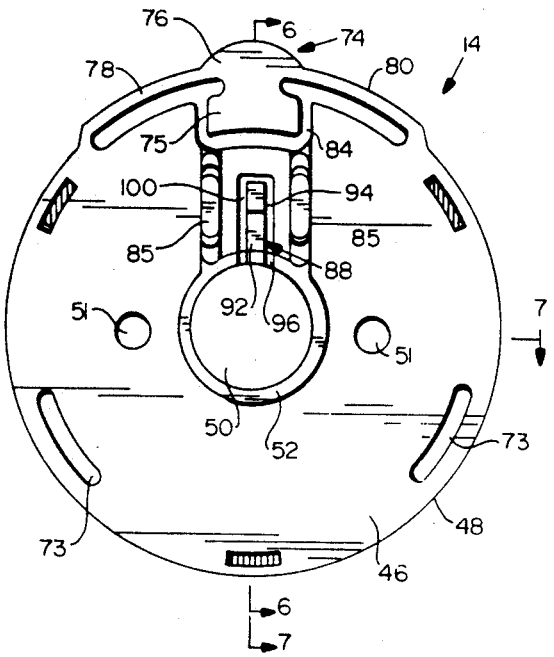
Fig. 5
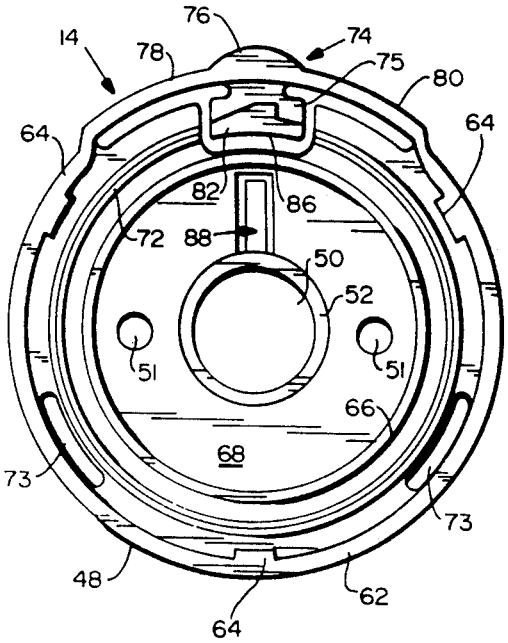
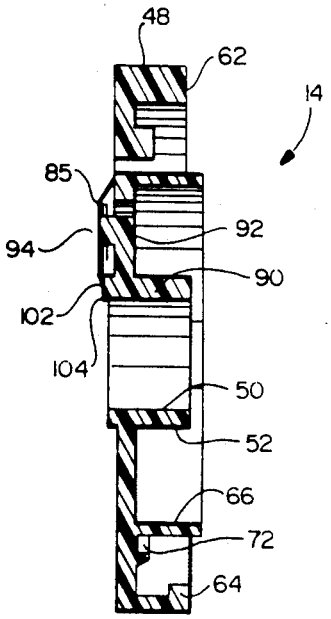
Fig. 6
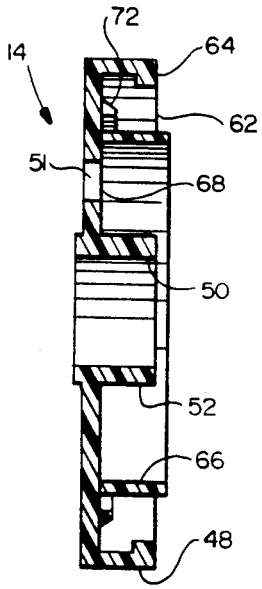
Fig. 7

MODULAR SPRINKLER ASSEMBLY

BACKGROUND OF THE INVENTION

This invention relates to modular sprinkler devices of the type which are dragged through crops, either suspended from truss span assemblies or along the ground. More specifically, the invention relates to an improved modular construction which prevents separation of sprinkler components during use.

Moving irrigation systems, such as conventional pivot move and lateral move systems, are known to incorporate conduit truss span assemblies and a plurality of drop tubes by which a corresponding number of sprayheads incorporating rotatable distributors (also referred to as rotor plates or spinners), fixed spray plates, or bubbler devices are suspended so as to be located in close proximity to crops or other plants.

In this regard, there is currently in use a modular sprayhead, also manufactured by the assignee of this invention, which includes a sprinkler body and a stream distributor (for example, a rotor plate or a fixed spray plate) which is designed for quick assembly and disassembly from the sprinkler body. The cap is secured to the sprinkler body by a conventional screw thread arrangement in combination with a locking mechanism where a plurality of vertically extending projections on the cap (extending from the cap surface by no more than about 1/16") engage a corresponding plurality of notches formed on the cap mounting ring when the cap reaches the full extent of its rotational movement relative to the body during threading. To disassemble the cap, the latter is simply rotated counterclockwise with sufficient force to disengage the projections from the notches.

The above described prior arrangement may experience problems in the field however, by reason of the detachment of the cap and rotor plate (or fixed spray plate) from the sprinkler body, rendering the sprayhead substantially inoperative. The detachment problem is caused by brushing engagement of the sprayhead with crops (such as cornstalks) as the system moves through a field. As a result, the prior locking mechanism is insufficient to withstand the rigors of use in its intended environment. Similar detachment problems may be experienced with sprinkler devices associated with known drag socks and drag hoses which are pulled along the ground.

It is the principal object of this invention to provide a modular construction which incorporates a stronger locking mechanism between the cap and sprinkler body components of the sprinkler, but which is nevertheless easy to disassemble for repair and/or replacement of the distributor, nozzle or other component.

It is another object of the invention to provide, in one exemplary embodiment, a second locking mechanism for securing the rotor plate or fixed plate to the cap, again in such a way as to facilitate assembly and disassembly.

In accordance with an exemplary embodiment of the invention, a modular sprinkler or sprayhead assembly includes a sprinkler body having an inlet and an outlet, and an interchangeable nozzle element removably fixed in the outlet. The sprinkler body is also formed with an upwardly extending frusto-conical portion which supports, by way of three equally circumferentially spaced posts, an annular cap mounting ring.

The annular mounting ring has a substantially vertical exterior surface formed with a plurality of discontinuous thread ramps separated by a plurality of circumferentially spaced gaps. Each ramp extends circumferentially from its free or starting end partially about the circumference of the ring and downwardly to a termination point defined by one of the respective posts.

The interior of the annular ring, also formed as a vertical surface, is formed with a plurality of equally circumferentially spaced detents which are adapted to cooperate with a mating latching element formed on the cap.

The cap portion of the sprinkler or sprayhead assembly is generally circular in shape and includes a top wall and an outer depending skirt portion. In this exemplary embodiment, the top wall is provided with a centrally located aperture for supporting a rotor plate. The rotor plate is formed with a plurality of water distribution surfaces which are configured to cause the plate and its associated shaft to rotate about a vertical axis (coincident with the shaft) and to distribute water radially outwardly from the sprinkler body. The shaft is received within a viscous brake housing which is releasably locked within the centrally located cap aperture by a flexible, hinged locking arm.

The outer annular surface of the skirt is provided at its lower edge with three, equally circumferentially spaced, radially inwardly directed tabs which are adapted to pass simultaneously through the correspondingly located gaps between the thread ramps on the annular mounting ring. The cap is placed on the ring to rotate it to a position where the tabs are aligned with the gaps. Once the tabs have been pushed downward through the gaps, clockwise rotation of the cap will cause the latter to be pulled downward onto the mounting ring by the thread ramps.

The cap is also formed with a radial thumb press which includes a pushbutton extending radially outwardly from the cap skirt and is connected to the cap skirt by means of a pair of thin circumferentially extending webs which provide the button with both radial and axial flexibility. The thumb press is integrally connected to a latching member which extends radially inwardly of the button and which is accommodated within a notch provided in the cap top wall. The underside of the latching member includes a wedge-shaped latching element which is substantially similar in shape to the wedge-shaped detents provided on the interior surface of the annular mounting ring.

The arrangement is such that after placement of the cap on the sprinkler body and upon clockwise rotation of the cap relative to the body, the wedge-shaped latching element will be resiliently biased upwardly and/or radially outwardly to allow the element to ride along the upper edge of the annular mounting ring. When the latching element finds the next adjacent wedge-shaped detent, it is resiliently pushed into the detent to thereby releasably lock the cap to the sprinkler body. The cap may be removed simply by pushing the thumb press button radially inwardly to release the latching element from the detent, thereby permitting counterclockwise rotation of the cap relative to the body.

In its broader aspects, the invention comprises a modular sprinkler construction comprising first means for emitting a liquid stream; second means for receiving the liquid stream; and third means for releasably connecting and disconnecting the second means to the first means, the third means including a radially extending element formed in one of the first and second means, adapted for engagement with the other of the first and second means.

In another aspect, the invention comprises a modular sprinkler assembly comprising a sprinkler body including a nozzle for emitting a liquid stream to atmosphere, and a cap removably secured to the sprinkler body, the cap mounting a distributor and associated housing for receiving and distributing the stream; the cap having a top wall and an annular skirt depending from a periphery of the top wall, the annular skirt formed with a radially inwardly extending latch element adapted to engage a detent provided in the sprinkler body.

In still another aspect, the invention comprises a modular sprinkler assembly comprising a sprinkler body including an inlet portion adapted for connection to a feed conduit, and an outlet portion for emitting water to atmosphere; and a cap removably attached to the sprinkler body, the cap mounting a distributor adapted to receive and distribute water emitted from the outlet portion, the cap having a hinged projection releasably engageable within a recess formed in the distributor.

It will be appreciated that the above described modular sprinkler or sprayhead (with rotatable or fixed distributor) is also usable in pivotal and lateral move irrigation systems equipped with drag socks, drag hoses, bubblers, and in other applications such as stationary tree crop systems, nursery/greenhouse systems, as well as in residential landscape systems.

Other objects and advantages of the invention will become apparent from the detailed description which follows.

BRIEF DESCRIPTION OF THE DRAWINGS

FIG. 1 is a side elevation, partly in section, of a modular sprinkler construction in accordance with an exemplary embodiment of the invention;

FIG. 2 is a side elevation of the body portion of the sprinkler construction shown in FIG. 1;

FIG. 3 is a top plan view of the sprinkler body portion shown in FIG. 2;

FIG. 4 is a top plan view of the cap portion of the sprinkler construction shown in FIG. 1, with the distributor assembly removed;

FIG. 5 is a bottom plan view of the cap shown in FIG. 4;

FIG. 6 is a side section taken along the line 6—6 in FIG. 4;

FIG. 7 is a side section taken along the line 7—7 in FIG. 4;

DETAILED DESCRIPTION OF THE DRAWINGS

Figure 8:
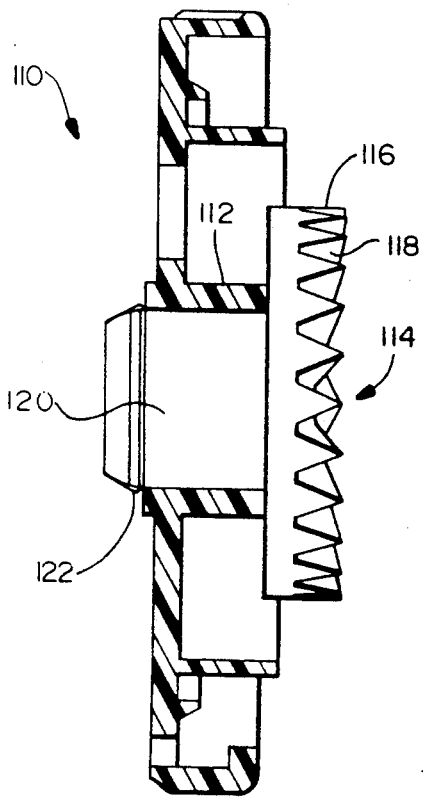
FIG. 8 is a section view similar to that shown in FIG. 7, but with a fixed spray plate attached.
Figure 9:
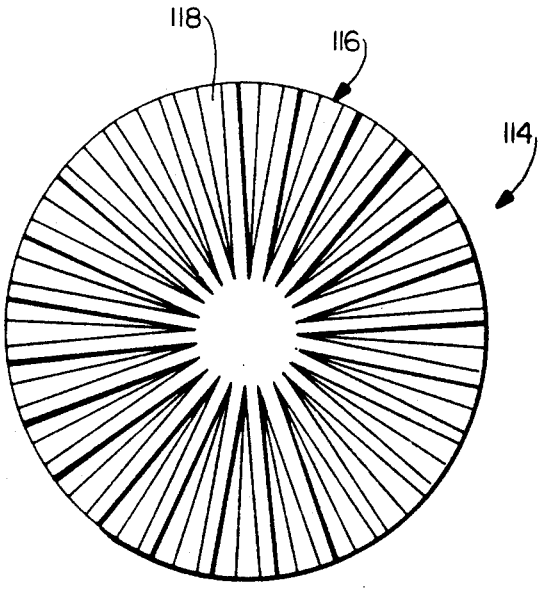
FIG. 9 is a bottom plan view of the fixed spray plate illustrated in FIG. 8.

Referring to FIG. 1, a modular sprinkler assembly 10 includes a sprinkler body 12 and a cap 14 removably attached thereto. The sprinkler body 12 threadably receives at its lower end an inlet bushing 16 which is also provided with exterior threads 18 for attachment to a water inlet hose, pipe or the like. The sprinkler body 12 is provided with an interiorly threaded outlet portion 20 which threadably receives a nozzle 22 having a discharge orifice 24. It will be appreciated that nozzle 22 is removable and interchangeable with other nozzles of different orifice size.

The body 12 is further provided with an upwardly and outwardly extending frusto-conical portion 26 which, in turn, supports a plurality (three in the exemplary embodiment) of upstanding posts 28 which support an annular cap mounting ring 30. Posts 28 are equally spaced about the frusto-conical portion 26. The frusto-conical portion 26 is provided with a plurality of ports 32 which provide physical and visual access to the nozzle 22.

As best seen in FIGS. 2 and 3, the annular ring 30 has a substantially vertical exterior surface 34 formed with a plurality of exterior, discontinuous thread ramps 36 separated by a plurality of equally circumferentially spaced gaps 38. Each ramp surface 36 extends from its free or starting end partially about the circumference of ring 30 and downwardly to a termination point at one of the respective posts 28.

The interior surface of the annular ring 30 is provided with a plurality of equally circumferentially spaced, wedge-shaped detents 40. Each detent 40 includes an inclined or ramp-like surface 42 and a shoulder or abutment 44 which are adapted to cooperate with a similarly shaped latching element, described below.

The modularity aspects of the sprinkler body 12 allow easy replacement or substitution of variously sized (or threaded) inlet bushings 16 and nozzles 22, depending on particular sprinkler applications. The body per se is preferably formed of a suitable plastic material, and the nozzle 22 while preferably formed of brass, may also be formed of plastic.

The cap 14 (also preferably plastic) is a generally circular structure, including a top wall or surface 46 and an outer, annular depending skirt 48. The top wall 46 is provided with a centrally located aperture 50, as defined by a cylindrical boss 52 which supports a rotary distributor or rotor plate 54 (FIG. 1), as well as drain apertures 51. The rotor plate 54 is formed with a plurality of water distribution surfaces 56, 58 which are configured to cause the rotor plate and an associated shaft (not shown) to rotate about a vertical axis, and to distribute the water radially outwardly from the sprinkler. The rotor plate shaft is received within a viscous brake housing 60 which is press fit within the aperture 50, and which controls the rotational speed of the rotor plate. The rotor plate and brake unit per se form no part of this invention and may be of the type described in commonly owned U.S. Pat. Nos. Re. 33,823, 4,796,811; and Des. 312,865.

The outer annular skirt 48 is provided at its lower edge 62 with a plurality (three in the exemplary embodiment) of equally circumferentially spaced, radially inwardly directed tabs 64 (see FIG. 5) which are adapted to pass simultaneously through the correspondingly located gaps 38 between the thread ramps 36 on the annular ring 30 when the cap 14 is placed on the ring 30 and rotated to a position where the tabs 64 are aligned with the gaps 38. It will be appreciated that the cap 14 will thus align with the sprinkler body in any of three positions, i.e., whenever one of the tabs 64 is aligned with any one of the three gaps 38. Then, upon rotation of the cap, the latter is pulled downward onto the ring 30 by the thread ramps 36 as described in greater detail below.

The cap 14 is also provided with an interior annular skirt 66 which lies radially between and concentric with outer skirt 48 and boss 52, and extending downwardly from the underside 68 of the cap top wall 46. This skirt 66 is adapted to seat on a shoulder 70 formed on the interior surface of support posts 28 (see FIGS. 1 and 2). The skirt is designed to guard the rotor plate shaft from plant or crop parts which might otherwise wrap about the shaft, and thus interfere or prevent rotation of the rotor plate.

Between the inner and outer annular skirts 48 and 66 is a concentric wedge ring 72, also extending from the underside 68 of the cap top wall 46. The purpose of wedge ring 72 is to maintain concentricity of the cap 14 relative to the sprinkler body 12 via engagement with the interior surface of ring 30. Between the wedge ring 72 and skirt 48 are circumferentially spaced, elongated holes 73 which permit escape of any silt or debris collected within the cap.

With specific reference to FIGS. 4 and 5, the cap 14 is also formed with a radial "thumb press" 74 which lies flush with the top wall 46. The thumb press includes a radially protruding button 76 which is connected to the skirt 48 by means of a pair of thin webs 78, 80 which provide the button 76 with primarily radial but also some axial flexibility. The thumb press 74 also includes a latching member 75 extending radially inwardly from the button 76. Integrally formed on the underside of the latching member 75 is a wedge-shaped (or other suitable shape) latching element 82 which is adapted to be received in any one of the detents 40 in the cap mounting ring 30 as described below. The latching member 75 and integral latching element 82 are accommodated within a notch or cut-out 84 formed in the cap top wall 46.

The radially interior surface 86 of the wedge-shaped element 82 is curved to correspond to the curvature of the wedge ring 72, but surface 86 extends slightly radially inwardly of the ring 72, so that the latching member 75 must be biased radially outwardly and/or upwardly to permit the cap 14 to be rotated into place as described below. It will be appreciated that the mounting of the latching member 75 by means of the thin webs 78, 80 impart the desired flexibility to the latching member 75 and integral element 82.

After placement of the cap 14 on the sprinkler body 12 as described above, and upon clockwise rotation of the cap 14 relative to the body, the wedge-shaped latching element 82 will be resiliently biased upwardly and/or radially outwardly to allow the element 82 to ride along the upper edge of the mounting ring 30. When the latching element 82 finds the next adjacent corresponding wedge-shaped detent 40, it will be resiliently pushed into the detent to thereby releasably lock the cap 14 to the sprinkler body 12. Further rotation in the clockwise direction is also precluded since all of the tabs 64 will be in engagement with respective posts 28 (which act as limit stops) when the element 82 is in one of the detents 40. To remove the cap 14, the thumb press button 76 is pushed radially inwardly to thereby release the latching element 86 from detent 40, thus permitting counterclockwise rotation of the cap to remove the latter from the sprinkler body.

Another feature of the invention relates to a releasable locking device for holding the rotor plate 54 and associated brake housing 60 as a separable unit within the aperture 50 of the cap 14. The locking device includes an arm 88 including a vertical portion 90 and a horizontal portion 92 which terminates in an upstanding button 94. The arm 88 is integrally joined to the bushing 52 along the lower edge of a vertical slot or cut-out 96 which accommodates the vertical portion 90. The horizontal portion is accommodated within a contiguous slot or cut-out 100 formed in the top wall 46, radially adjacent the earlier described cut-out 84. The top wall is formed with a pair of ribs 85 on either side of cut-out 100. These ribs prevent accidental or inadvertent pressing of the button 94 during use, which might otherwise result in undesirable separation of the cap from the body. The upper end of the vertical arm portion 90 is formed with a projection 102 which includes a radially inwardly directed lip 104 which is adapted to be received in an annular groove 108 formed in the housing 60 (see FIG. 1).

It will be appreciated that the arm 90 is flexible in that it may pivot or hinge about its joinder with bushing 52 so that, when the button 94 is pressed downwardly, the pivoting movement of the arm 90 away from housing 60 causes lip 104 to disengage from the groove 108, thereby allowing the housing 60 to be pushed downwardly through the aperture 50, separating the rotor plate 54 and housing 60 from the cap. Assembly of the spinner/brake housing unit may be achieved simply by pushing the housing upwardly through the aperture 50 until lip 104 snaps into the groove 108.

With reference now to FIGS. 8 and g, a cap 110 otherwise similar to the cap illustrated in FIGS. 1 and 4–7, has attached thereto a fixed spray plate 114. The fixed spray plate 114 includes a grooved, disc-like distributor portion 116 provided with a plurality of radially extending distribution grooves 118 extending between the center and radially outward edge of the distributor. The fixed spray plate is also provided with a generally cylindrical attachment portion 120 which is press fit within the central boss 112 of the cap. An annular rib or projection 122 holds the spray plate in place within the cap, and it will be appreciated that the spray plate is removable by exertion of an axially directed force sufficient to push the attachment portion 120 and rib 122 through the boss 112. The manner in which the cap 110 is applied, retained, and released from an associated sprinkler body is identical to that described in conjunction with FIGS. 1–7.

As indicated hereinabove, the modular connection mechanisms of this invention are also applicable to other similar sprinkler devices which are utilized in conjunction with drag socks, drag hoses and bubbler devices. In drag sock applications, the nozzling features of the sprinkler are utilized for accurate water metering and the cap is also utilized as a mounting platform for the sock or drag hose. In bubbler applications, the sprinkler is enclosed within an energy dissipating hood which may also be secured to the cap.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A modular sprinkler assembly comprising:

a sprinkler body including an inlet portion adapted for connection to a feed conduit, and an outlet portion for emitting a liquid stream to atmosphere; and a cap removably attached to said sprinkler body, said cap mounting a distributor adapted to receive and distribute liquid emitted from said outlet portion, said cap having a flexible and radially inwardly extending latching element releasably engaged within a detent provided on said sprinkler body for releasably holding said cap on said sprinkler body.

2. The modular sprinkler assembly of claim 1 wherein said outlet portion includes a removable nozzle.

3. The modular sprinkler assembly of claim 1 wherein said sprinkler body includes an annular cap support ring spaced from said outlet portion, said annular cap support ring having a plurality of discrete screw thread portions thereon; said cap having an annular skirt portion formed with a plurality of radially inwardly directed circumferentially spaced tabs, each adapted to engage a respective one of said screw thread portions.

4. The modular sprinkler assembly of claim 3 wherein said screw thread portions are separated by gaps which are circumferentially aligned with said tabs to thereby provide a plurality of thread starts for initiating threading of said cap to said sprinkler body.

5. The modular sprinkler assembly of claim 1 wherein said distributor comprises a rotor plate and said cap includes a braking device operatively connected to said rotor plate for controlling rotational speed of said rotor plate.

6. The modular sprinkler of claim 1 wherein said distributor comprises a fixed spray plate.

7. The modular sprinkler assembly of claim 5 wherein said braking device comprises a viscous brake.

8. The modular sprinkler assembly of claim 1 wherein said latching element is substantially wedge-shaped.

9. The modular sprinkler assembly of claim 1 wherein said sprinkler body includes a plurality of said detents, said latching element engageable with any one of said detents.

10. The modular sprinkler assembly of claim 7 wherein said at least one detent is also substantially wedge-shaped.

11. The modular sprinkler assembly of claim 9 and wherein said latching element is resiliently mounted in said cap and includes an integral button adapted to be pressed radially inwardly to release said latching element from said detent.

12. The modular sprinkler assembly of claim 5 wherein said braking device includes a housing provided with an annular groove, and said cap is provided with a hinged projection for releasable engagement with said annular groove.

13. A modular sprinkler assembly comprising:

a sprinkler body including a nozzle for emitting a liquid stream to atmosphere, and a cap removably secured to said sprinkler body, said cap mounting a distributor and associated housing for receiving and distributing said stream; said cap having a top wall and an annular skirt depending from a periphery of said top wall, said annular skirt formed with a radially inwardly extending latching element adapted to engage a detent provided in said sprinkler body, and wherein said latching element is substantially coplanar with said top wall.

14. The modular sprinkler assembly of claim 13 wherein said top wall is formed with a notch for accommodating said latching element.

15. The modular sprinkler assembly of claim 14 wherein said latching element is secured to said annular skirt on opposite sides of said notch.

16. The modular sprinkler assembly of claim 13 wherein said latching element is secured to said annular skirt by a pair of flexible webs which lie outside a diameter of the skirt.

17. The modular sprinkler assembly of claim 13 wherein said sprinkler body includes an annular cap support ring spaced from said outlet portion, said annular cap support ring having a plurality of discrete screw thread portions thereon separated by gaps; said cap having an annular skirt portion formed with a plurality of radially inwardly directed circumferentially spaced tabs wherein each of said tabs is alignable with a respective one of said gaps to thereby permit said tabs to engage said screw thread portions upon subsequent rotation of said cap relative to said sprinkler body.

18. The modular sprinkler assembly of claim 17 wherein said ring is supported by a plurality of upstanding posts extending upwardly from said sprinkler body, each post engaging one end of a respective one of said screw thread portions, said posts thereby serving as stops for limiting rotation of said cap.

19. The modular sprinkler assembly of claim 17 wherein said sprinkler body is formed with three detents substantially equally spaced about said annular cap support ring.

20. A modular sprinkler assembly comprising:

a sprinkler body including a nozzle for emitting a liquid stream to atmosphere, and a cap removably secured to said sprinkler body, said cap mounting a distributor and associated housing for receiving and distributing said stream; said cap having a top wall and an annular skirt depending from a periphery of said top wall, said annular skirt formed with a radially inwardly extending latching element adapted to engage a detent provided in said sprinkler body, wherein said sprinkler body includes an annular cap support ring spaced from said outlet portion, said annular cap support ring having a plurality of discrete screw thread portions thereon separated by gaps; said cap having an annular skirt portion formed with a plurality of radially inwardly directed circumferentially spaced tabs wherein each of said tabs is alignable with a respective one of said gaps to thereby permit said tabs to engage said screw thread portions upon subsequent rotation of said cap relative to said sprinkler body, and further wherein said latching element rides on an upper edge of said support ring during rotation of said cap until said latching element engages with said detent.

21. The modular sprinkler assembly of claim 13 wherein said housing is held within an aperture in said cap by resilient engagement of a projection on said cap in an annular groove in said housing.

22. A modular sprinkler assembly comprising:

a sprinkler body including an inlet portion adapted for connection to a liquid supply conduit, and an outlet portion for emitting the liquid to atmosphere; and a cap removably attached to said sprinkler body, said cap having a top wall with a centrally located aperture mounting a distributor adapted to receive and distribute liquid emitted from said outlet portion, said cap having a hinged arm with a projection at one end releasably engageable within a recess formed in said distributor, and an upstanding button at an opposite end extending above said top wall for releasing said projection from said recess upon exertion of a downward force thereon.

23. The modular sprinkler assembly of claim 22 wherein said distributor includes a rotor plate mounted on a shaft, said shaft received within a brake housing, and wherein said recess comprises an annular groove in said housing.

24. The modular sprinkler assembly of claim 23 and wherein said cap is releasably secured to said sprinkler body by a resilient latching element provided on said cap and engageable within a detent formed in said sprinkler body.

25. The modular sprinkler assembly of claim 22 wherein said distributor comprises a fixed spray plate.

* * * * *